US006063444A

United States Patent [19]

Dax

[11] Patent Number: 6,063,444

[45] Date of Patent: May 16, 2000

[54] BAS-RELIEF PROCESS

[75] Inventor: Elizabeth Dax, Annapolis, Md.

[73] Assignee: Niermann Weeks Company, Inc., Millersville, Md.

[21] Appl. No.: 09/208,583

[22] Filed: Dec. 10, 1998

[51] Int. Cl.[7] ..... B05D 1/32; B05D 7/06

[52] U.S. Cl. ..... 427/272; 427/277; 427/369; 427/408

[58] Field of Search ..... 427/277, 282, 427/369, 271, 272, 408; 428/542.2; 264/293

[56] References Cited

U.S. PATENT DOCUMENTS

| | | |
|---|---|---|
| 278,238 | 5/1883 | Harding . |
| 333,459 | 12/1885 | Gibson . |
| 415,427 | 11/1889 | Wick . |
| 591,245 | 10/1897 | Carlewitz . |
| 613,625 | 11/1898 | Furness . |
| 683,425 | 10/1901 | Anderson et al. . |
| 774,607 | 11/1904 | Schmitt . |
| 1,053,937 | 2/1913 | Anderson . |
| 2,026,202 | 12/1935 | Zeve . |
| 2,468,731 | 5/1949 | Borkland . |
| 2,704,905 | 3/1955 | Ernst . |
| 3,287,193 | 11/1966 | Klein . |
| 3,444,032 | 5/1969 | Kreier, Jr. . |
| 3,537,874 | 11/1970 | Ramey . |
| 3,672,926 | 6/1972 | Ramey . |
| 3,744,152 | 7/1973 | Crasilneck . |
| 4,135,020 | 1/1979 | Maxwell . |
| 4,268,615 | 5/1981 | Yonezawa . |
| 4,677,001 | 6/1987 | Wade et al. . |
| 5,133,621 | 7/1992 | Gonzales . |

*Primary Examiner*—Fred J. Parker
*Attorney, Agent, or Firm*—Millen, White, Zelano & Branigan

[57] ABSTRACT

A bas-relief is formed on a wooden panel, such as a furniture panel, by using a MYLAR® stencil having the outline of a design forming the bas-relief and a rubber stamp having a negative of the relief incorporating depth and textural features of the design. The MYLAR® stencil is laid over the panel and spackle is applied over the stencil to form a spackle layer having the outline of the design. The spackle layer is then embossed with the rubber stamp to provide details of depth in the spackle layer and thus form the bas-relief. The bas-relief is then allowed to dry, is painted or glazed and is covered with a layer of varnish.

17 Claims, 4 Drawing Sheets

BAS-RELIEF PROCESS

FIELD OF THE INVENTION

The present invention relates to a bas-relief process. More particularly, the present invention relates to a bas-relief process in which a layer of material is applied to a surface.

BACKGROUND OF THE INVENTION

There is substantial demand for furniture which is adorned with various patterns which provide furniture pieces with a familiar antique style, if not an actual antique finish. While for many people actual antiques are highly prized and desirable, such pieces are frequently expensive and not necessarily suitable for day to day use because of time induced wear and tear and because additional wear and tear can reduce the value of the piece.

Since actual antiques can be extremely expensive and selected antique items are often unavailable, there has arisen a market for new furniture and furnishing which may have the appearance of substantial age. When manufactured and finished with skill, these "new" antiques are highly prized by the knowledgeable public and are relatively expensive.

In authentic, expensive antique furnishings with bas-relief decoration bas-relief designs are formed on the surface by carving and planing. In other antiques, bas-relief is formed by gluing or nailing decorative designs to panels, and in still other less expensive antique reproductions bas-relief is provided by gluing molded plaster decorations to the piece.

Generally, when making furniture pieces with bas-relief designs, there is a need for a relatively inexpensive process which will withstand passage of time as well as wear and tear due to use, yet appears to even a practiced eye to be carved into the wood.

SUMMARY OF THE INVENTION

In view of the aforementioned considerations, it is a feature of the present invention to provide a new and improved process for forming bas-relief designs.

In view of this feature and other features, the present invention is directed to determining a general configuration for a bas-relief wherein the bas-relief has a two-dimensional component defining a pattern and a three-dimensional component super-imposed upon the pattern to provide depth. A stencil is then formed defining an outline and pattern and a negative of the bas-relief, incorporating the three-dimensional aspects thereof, is made. The stencil is placed in abutment with the surface to receive the bas-relief and a hardenable material is wiped over the stencil, the hardenable material being initially deformable and adhering to the surface.

The stencil is removed to leave the outline of the bas-relief pattern. While the material is pliable, the three-dimensional negative is pressed against the outline of the bas-relief pattern on the surface to incorporate the three-dimensional characteristics of the bas-relief into the bas-relief pattern. The bas-relief pattern is then allowed to harden.

In a further aspect of the invention, the hardenable material is spackle and in still a further aspect, the stencil is formed on a MYLAR® sheet.

In still a further aspect of the invention, the three-dimensional negative is formed in a block of rubber to form a rubber stamp.

In further aspects of the invention, the surface is on a panel of wood and the wood panel is incorporated into an article of furniture with the panel oriented vertically.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
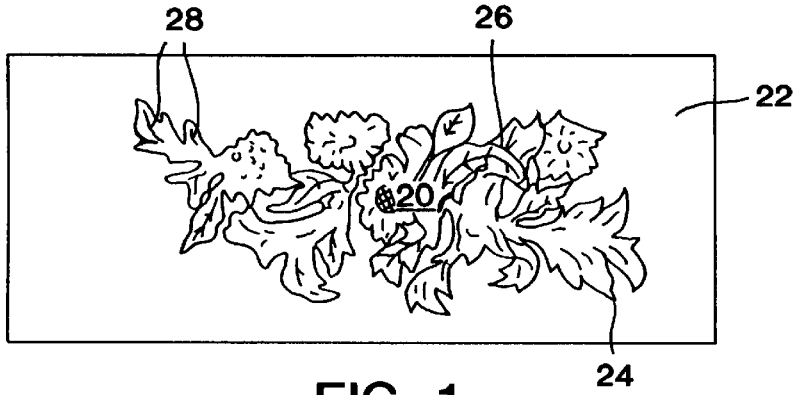
FIG. 1 is a planar view of an image of a design to be incorporated on a surface of an article such as, but not limited to, a piece of furniture.

Referring now to the drawings, FIG. 1 is an illustration of a design 20 which is to be incorporated in the surface of an article such as, for example, a furniture piece. The design 20 may be a drawing or a photograph and is on a backing such as, for example, a sheet of paper 22. Accordingly, the design 20 is a two-dimensional illustration defined by an outline 24. The drawing also has areas defined by lines 26 which will have depth in a bas-relief and lines such as lines 28 which provide texture to the bas-relief.

Figure 2:
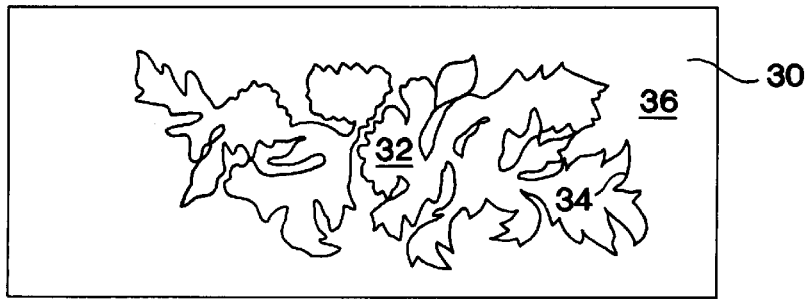
FIG. 2 is a two-dimensional outline of the pattern of the drawing of FIG. 1 showing a MYLAR® sheet with cutaway portions to define a stencil.

FIG. 2 illustrates a stencil 30 is made of a flexible transparent sheet of material, preferably plastic, such as the polyester material, MYLAR®. The stencil 30 has cut-out 32 having a perimeter 34 matching the outline 24 of the design 20 so that the cut-out 32 defines a pattern within the remaining portions 36 of the stencil 30. The stencil 30 has a thickness 37 which is substantially equal to the thickness of the bas-relief.

Figure 3:
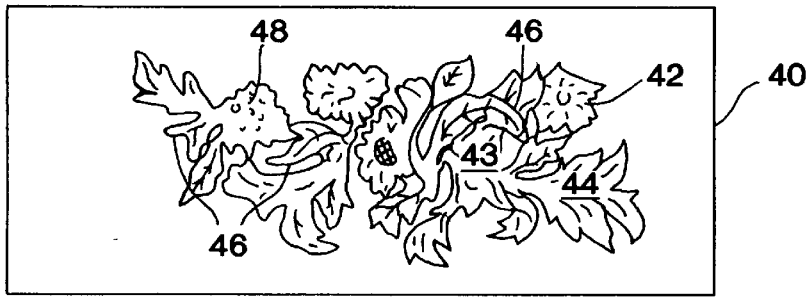
FIG. 3 is a face view of a negative of the image of FIG. 1 incorporating three-dimensional characteristics thereof in the face of a rubber stamp.
Figure 4:
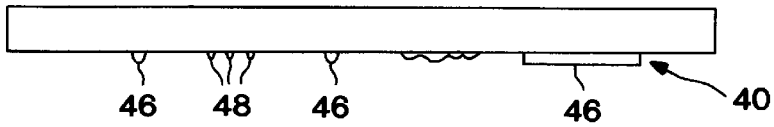
FIG. 4 is a schematic elevation of the rubber stamp taken along a section line through FIG. 3 thereof.

Referring to FIGS. 3–4, a three-dimensional negative 40 of the design 20 is shown, wherein the face 42 of the three-dimensional negative has a corresponding design 43 thereon which preferably has an outline 44 which corresponds to the outline 24 of the two-dimensional design 20 of FIG. 1. The outline 44 is the same as the outline 24 of FIG. 1 and the outline 34 of FIG. 2, rather than being a reversed or mirror image thereof. The design 43 is negative of the design 20 of FIG. 1 in that it has projecting portions 46 corresponding to the desired indentations 26 in the design 20 and other projections 48 which correspond to texture lines 28 of the design 20. It is also possible that the three-dimensional negative 43 might include grooves which are used in texturing the bas-relief. While other materials may be used to configure the three-dimensional negative 40, a preferable material is rubber which is elastic and therefore at least slightly deformable.

Figure 5:
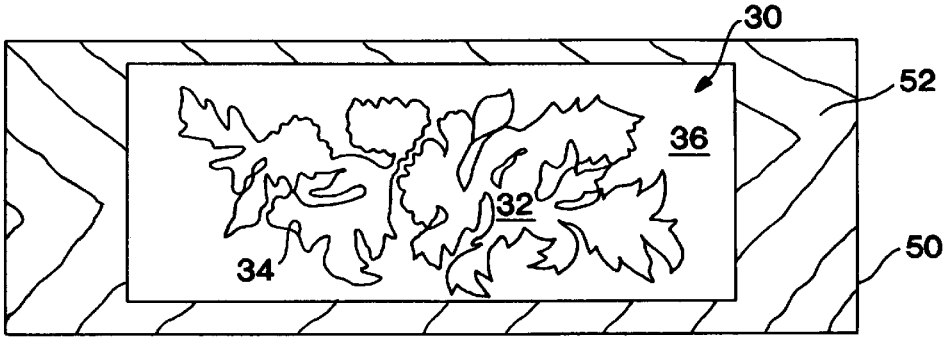
FIG. 5 is a planar view of a panel to receive the bas-relief design as illustrated in FIG. 1, with a panel having the MYLAR® stencil laid thereover.

Referring now to FIG. 5, it is seen that the MYLAR® stencil 40 is laid on or abutted against a panel 50. The panel 50 may, for example, be a portion of a furniture piece made of wood which has a wood surface 52. The wood surface 52 has a texture of small and frequently microscopic fibers and voids which provide a surface that is conducive to bonding by a hardenable substance such as plaster or spackle, spackle being a type of plaster.

Figure 6:
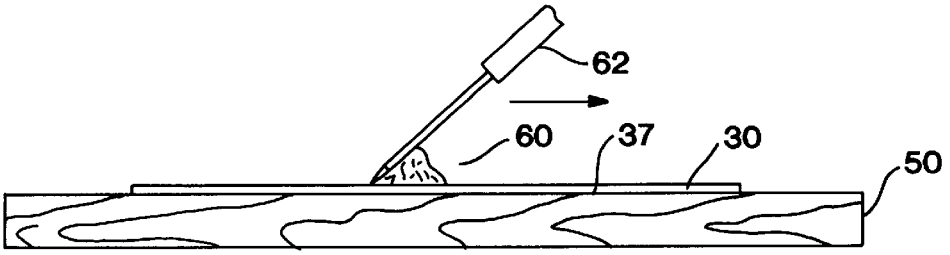
FIG. 6 is a side view showing spackle being applied over the MYLAR® stencil of FIGS. 2 and 5.

Referring now to FIG. 6, a hardenable material 60 is applied over the MYLAR® stencil 30 with a spackle knife 62. A preferable hardenable material 60 is spackle such as Synkloid spackle, which is available from the Synkloid Company of Beyone, N.J., and which is in the form of a paste applied directly from its container over the MYLAR® stencil 30. The spackle 60 contacts the wood of the surface 52 directly through the cut-out 32 that defines the outline 34 of the design 20 shown in FIG. 1. The remainder of the spackle, not in the area 32, remains on the surface 34 of the MYLAR® stencil 30. The thickness 37 of the stencil 30 determines the height of the spackle deposit on the surface 52 of the wood panel 50.

Figure 7:
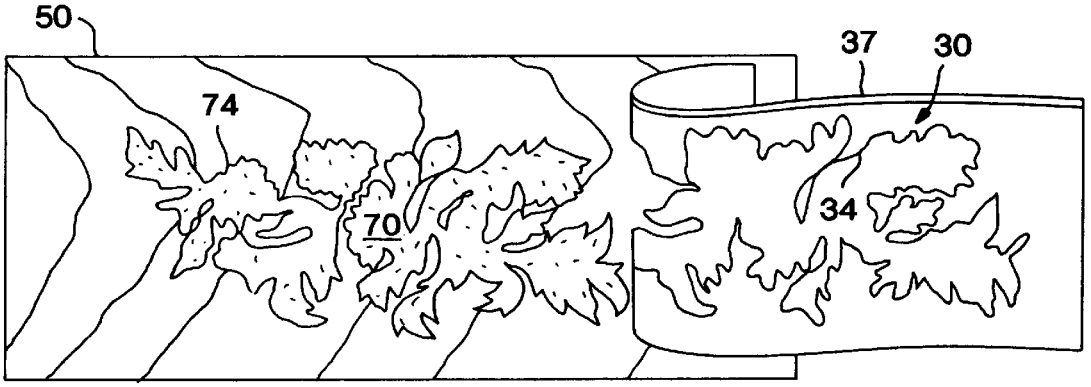
FIG. 7 is a top view showing the MYLAR® stencil being stripped from the panel of FIGS. 5 and 6 so as to leave an outline of the pattern of the design of FIG. 1.

As is seen in FIG. 7, the MYLAR® stencil 30 is stripped from the surface 52 of the panel 50 to leave a deposit 70 of spackle which is confined within a perimeter 74 which duplicates the outline 34 of the stencil 30 and the outline 24 of the design 20 of FIG. 1. When using a hardenable material such as the spackle 60, the deposit 70 is allowed to stand for 15 to 20 minutes so as to reach a desired level of stiffness.

Figure 8:
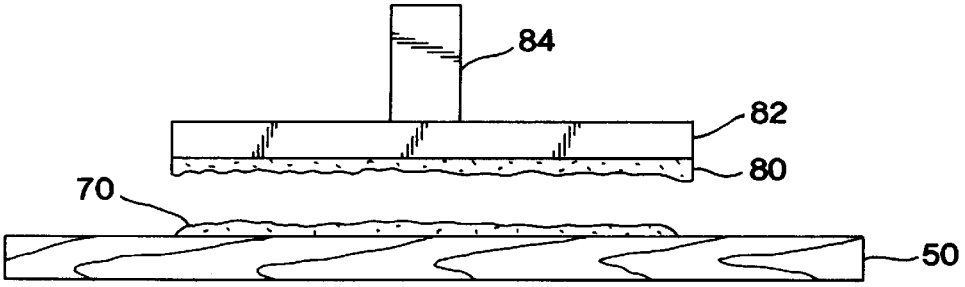
FIG. 8 is a side elevation showing the stamp of FIGS. 3 and 4 applying the third dimension of depth to the pattern of FIG. 7.

Referring now to FIG. 8, after the spackle deposit 70 (shown slightly exaggerated in height for clarity) reaches the desired level of stiffness so that it will not flow too readily when embossed, the three-dimensional negative 40 (see FIGS. 3 and 4) in the form of a rubber stamp 80 supported on a base 82 and manipulated by a handle or handles 84, is aligned with the spackle deposit 70 and pressed against the spackle deposit The projections 46 and 48 (see FIGS. 3 and 4), press into the spackle deposit 70 to provide indentations therein which correspond to the indentations 26 and texture lines 28 of the design 20 shown in FIG. 1. Three dimensional detail is thus added to the deposit 70 to form a bas-relief 90 having indentations 92, and texture lines 94 corresponding to the depth areas 26 and 28 of the design 20 shown in FIG. 1. The bas-relief 90 has a perimeter 96 (see FIGS. 9–11) which corresponds to the perimeter 24 of the design 20 and at its back surface 97, is intermingled with the wood filters and voids of the surface 52 of panel 50. The bas-relief 90 is then allowed to completely dry, which generally takes about three to four hours. After drying, the bas-relief 90 is rigid and bonded to the surface 52 of the panel 50 and is ready for final processing.

Figure 9:
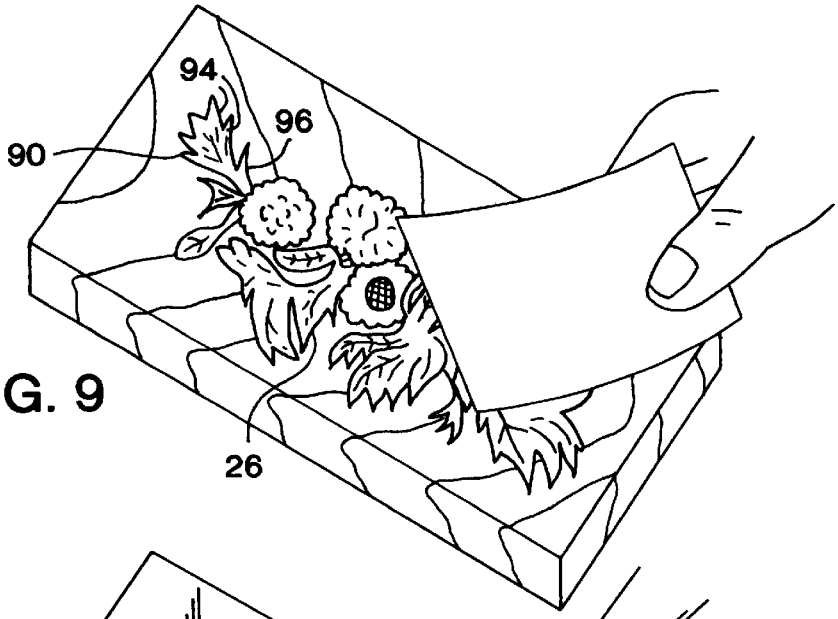
FIG. 9 is a planar view showing the embossed pattern of FIG. 8 being sanded.

Referring further to FIG. 9, final processing comprises finishing steps such as sanding the bas-relief 90 to remove rough and sharp edges with a fine gait sandpaper, such as 220-grit sandpaper.

Figure 10:
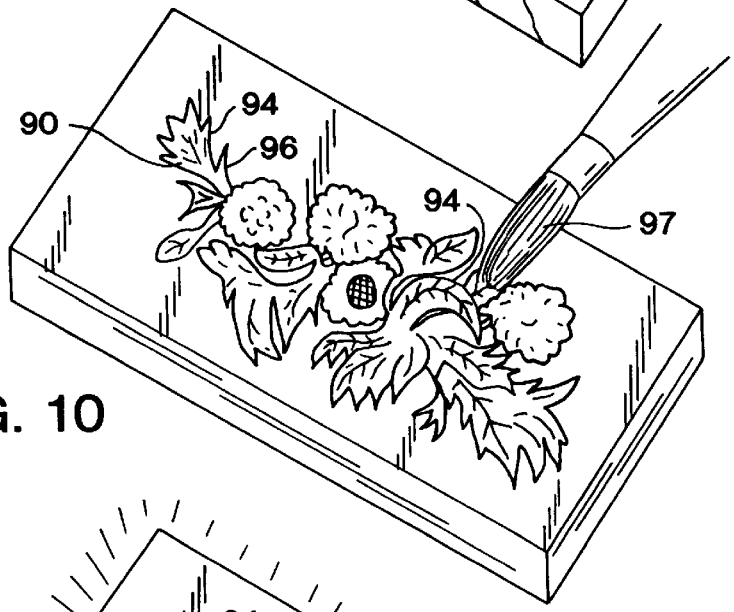
FIG. 10 is a planar view showing the bas-relief being painted or glazed.
Figure 11:
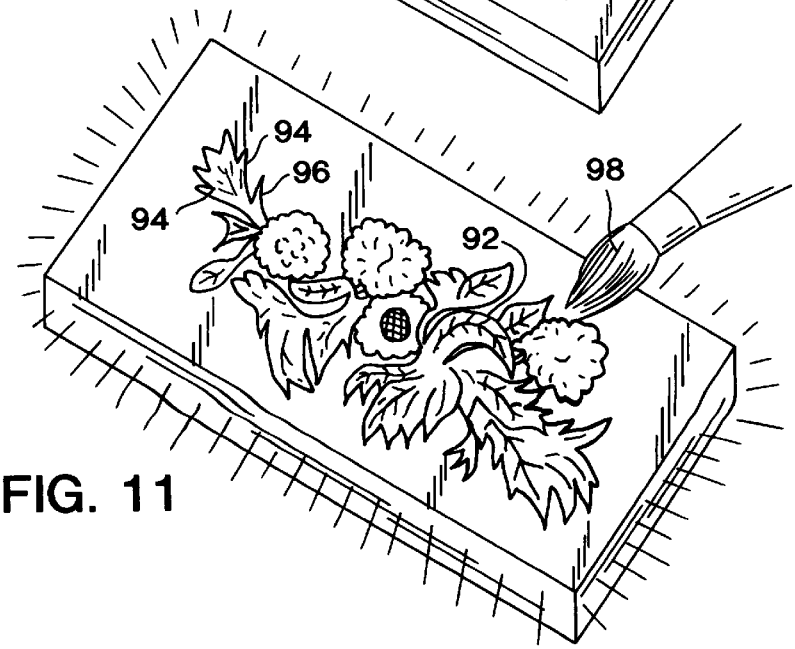
FIG. 11 is a planar view showing the bas-relief receiving a protective layer.

The finishing process may also involve painting and glazing the surface of the bas-relief 90 with paint or glaze 97 as is shown in FIG. 10 and, after drying, (as shown in FIG. 11) providing a protective coat, which also serves as a finish coat, by applying a material such as varnish 98. Preferably, the varnish 98 is an acrylic, urethane, water-based satin varnish such as, for example, Aquaplastic Varnish available from the Coronado Paint Company of Edgewater, Fla.

Figure 12:
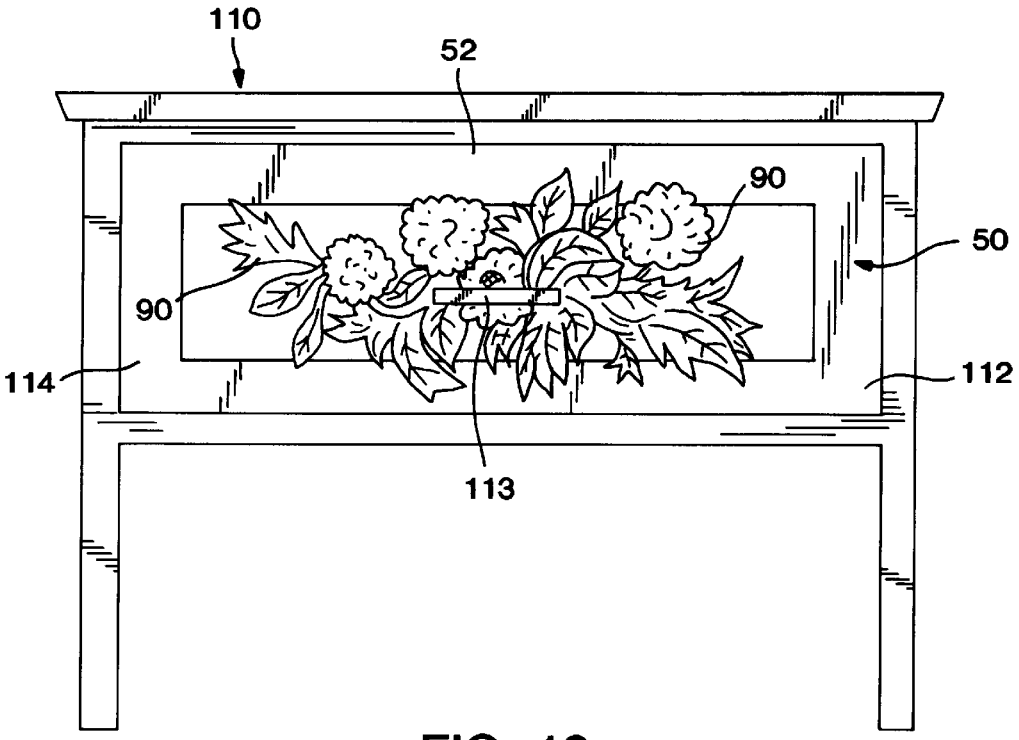
FIG. 12 is a front view of a furniture piece, such as a table, displaying a bas relief formed by the process of FIGS. 1–11.

Referring now to FIG. 12, the panel 50 is shown incorporated into a furniture piece such as a desk 110 as a front panel face 113. In the illustrated embodiment, the front panel face 113 may include a drawer face front 113 and a surrounding panel face 114. As is seen in FIG. 12, the bas relief 90 may be applied in part to the drawer 112 and in part to the surrounding panel face 114 so that the spackle overlaps both. Since the bas-relief 90 is made of spackle 60, it maintains its shape and has a long life even when mounted on a vertical surface, due to a large degree to its ability to tightly bond with the wood surfaces of the panel elements on which it is mounted.

From the foregoing description, one skilled in the art can easily ascertain the essential characteristics of this invention, and without departing from the spirit and scope thereof can make various changes and modification of the invention to adapt it to various usages and conditions.

I claim:

1. A process for forming a bas-relief on a surface comprising:

determining a general configuration for a bas-relief wherein the bas-relief has a two-dimensional component defining a pattern having an outline and a three-dimensional component super-imposed upon the pattern to provide depth;

forming a stencil of the pattern;

making a negative of the bas-relief incorporating the three-dimensional aspect thereof, laying the stencil against the surface to receive the bas-relief;

wiping a hardenable material over the stencil, wherein the hardenable material is initially flowable and adheres to the surface;

removing the stencil to leave the outline of the bas-relief pattern on the surface;

pressing the three-dimensional negative against the bas-relief pattern on the surface to incorporate the three-dimensional characteristics of the bas-relief into the bas-relief pattern by embossment; and allowing the resulting bas-relief pattern having the three-dimensional characteristics to harden.

2. The process of claim 1, wherein the hardenable material is spackle and wherein upon removing the stencil just after applying the spackle, the resulting pattern is allowed to stand for a sufficient time to become stiff enough to receive three-dimensional characteristics without incurring substantial distortion after pressing the three-dimensional characteristics into the spackle.

3. The process of claim 2, wherein the stencil is formed in a flexible, plastic sheet of material which is transparent.

4. The process of claim 3, wherein the three-dimensional negative is formed in a block of rubber to form a rubber stamp.

5. The process of claim 4, wherein the embossed bas-relief is sanded after hardening.

6. The process of claim 5, wherein the bas-relief is painted and glazed.

7. The process of claim 6, wherein the painted and glazed bas relief is coated with a protective layer.

8. The process of claim 7, wherein the protective layer is a layer of acrylic urethane, water-based satin varnish.

9. The process of claim 8, wherein the surface is on a panel of wood.

10. The process of claim 9, wherein the panel of wood is incorporated into an article of furniture.

11. The process of claim 1, wherein the surface is a panel made of wood.

12. The process of claim 1, wherein the panel is oriented vertically after the bas-relief pattern hardens.

13. The process of claim 12, wherein the panel is oriented vertically.

14. The process of claim 13, wherein the hardenable material is spackle.

15. The process of claim 14, wherein the three-dimensional negative is formed on a rubber stamp.

16. A process for forming a bas-relief on a surface of a wood panel used for furniture comprising:

determining a general configuration for a bas-relief wherein the bas-relief has a two-dimensional component defining a pattern having an outline and a three-dimensional component super-imposed upon the pattern to provide depth;

forming a stencil of the pattern;

making a negative of the bas-relief incorporating the three-dimensional aspect thereof;

laying the stencil against the surface to receive the bas-relief;

wiping a hardenable material over the stencil, wherein the hardenable material is initially flowable and adheres to the surface;

removing the stencil to leave the outline of the bas-relief pattern on the surface;

pressing the three-dimensional negative against the bas-relief pattern on the surface to incorporate the three-dimensional characteristics of the bas-relief into the bas-relief pattern by embossment; and allowing the resulting bas-relief pattern having the three-dimensional characteristics to harden.

17. The process of claim 16 wherein the wood panel forms the front panel face of a furniture piece including a drawer face within the panel face any wherein the bas-relief overlaps both the drawer face and the panel face.

* * * * *